US005487414A

United States Patent [19]

Kuji et al.

[11] Patent Number: 5,487,414

[45] Date of Patent: Jan. 30, 1996

[54] DOUBLE LAYER PAPER-MAKING FABRIC

[75] Inventors: Takehito Kuji, Tokyo; Tatsuhiko Yasuoka, Shizuoka, both of Japan

[73] Assignee: Nippon Filcon Co., Ltd., Tokyo, Japan

[21] Appl. No.: 297,567

[22] Filed: Sep. 1, 1994

[30] Foreign Application Priority Data

Sep. 6, 1993 [JP] Japan ..... 5-254624

[51] Int. Cl.[6] ..... D03D 23/00

[52] U.S. Cl. ..... 139/383 A; 428/225; 428/229; 428/257

[58] Field of Search ..... 428/225, 257, 428/229; 139/383 A

[56] References Cited

U.S. PATENT DOCUMENTS 4,709,732 12/1987 Kinnunen ..... 139/383 A 5,067,526 11/1991 Herring ..... 139/383 A

*Primary Examiner*—James J. Bell

*Attorney, Agent, or Firm*—Beveridge, DeGrandi, Weilacher & Young

[57] ABSTRACT

A fabric for use in paper machines which forms a repeating design unit with fourteen yarns or more for each of warps, upper wefts and lower wefts is shown. The fabric starts the repeating design unit from a point of the lower weft being interwoven with the warp, wherein the lower wefts are interwoven with the warp once or twice, adjacent two upper wefts are interwoven with the warp twice, the numbers of wefts disposed between positions of the warp interweaving the lower weft and the adjacent two upper wefts are equal to each other, and the warp travels between the upper and lower wefts in a substantially linear manner between two positions of the adjacent two upper wefts being interwoven with the warp.

18 Claims, 15 Drawing Sheets

DOUBLE LAYER PAPER-MAKING FABRIC

BACKGROUND OF THE INVENTION

The invention relates to a fabric for use in paper machines.

Various requirements have been placed on paper-making fabrics. For example, avoiding formation of wire marks, improving wear resistance, increasing paper-making retention or improving drainage capability has been required. In particular, increasing the wear resistance of a paper-making fabric has become the most important factor. This is particularly true when considering recent increases in paper-making speed, an increased amount of fillers to be used and an increase in neutral paper-making as well as various measures to reduce manufacturing costs in paper-making companies.

However, the only practical approaches to improving the wear resistance of the fabric are achieved by causing wefts to be worn on the machine side, thereby avoiding wear of warps. This type of the fabric is in a weft wear condition on the machine side. The term "machine side" used herein means the side of the fabric facing the machine. Because the wefts are worn to a greater degree than the warps, some attempts have been made to use, as the wefts, polyamide monofilaments having the desired wear resistance or threads having a larger diameter. However, fabrics having yarns interwoven with the polyamide monofilaments are inferior in stability. To enhance the stability of the fabric, polyester monofilaments may be used. In other words, the polyamide monofilaments can only be used as long as they are interwoven with the polyester monofilament to form the fabric. On the other hand, the threads having larger diameter are not well balanced with other threads and cause an uneven surface of the fabric, resulting in the formation of wire marks. Thus, these methods are disadvantageous from the consideration of practical applications.

Another approach to improve the wear resistance of the fabric has been proposed, for example, in Japanese Laid-open Patent Application No. 62-276097/1987, which discloses a fabric improved in wear resistance. The fabric disclosed is a 14-shaft double layer woven fabric forming a long weft crimp on the machine side of the fabric that is extended under eleven warps. As seen from the paper side of the fabric, this 14 shaft double layer weave fabric looks like a seven shaft double layer weave fabric which has been used for general use. The term "paper side" used herein means the side of the fabric facing the paper to be made, and the term "shaft with a plural number" means the least number of wefts or warps which form a minimum repeating unit of a fabric.

The long crimp of a weft mentioned above increases the effective wearing volume of the fabric and permits the use of yarns having larger diameter, which is advantageous in view of improving the wear resistance.

However, this fabric still has a serious potential problem of forming wire marks.

To facilitate an understanding of the invention, such problems will be described according to FIGS. 7*a*, 7*b*, 8*a* and 8*b*. When a warp passes over or under a pair of upper and lower wefts, namely, upper wefts being extended on the paper-making side of a fabric and lower wefts extended on the machine side of the fabric, this condition is referred to herein as the wefts are "woven into a fabric". In the case where a warp passes under a lower weft, this is referred to herein as the lower weft interwoven with a warp. On the other hand, another case where a warp passes above adjacent upper wefts is referred to as an upper weft interwoven with a warp.

FIG. 7*b* is a cross sectional view of a repeating design unit of a conventional seven shaft weave fabric for use in paper machines shown in FIG. 7*a*, taken along a warp 17 thereof. In FIGS. 7*a* and 7*b*, the distance between lower weft 1 interwoven with warp 17 and upper weft 5' interwoven with the warp 17 is equal to three weft counts. On the other hand, the distance between upper weft 6' interwoven with warp 17 and lower weft 1 of the subsequent design is equal to one weft count.

FIG. 8*b* is a cross sectional view of a repeated unit design of another conventional 14-shaft weave fabric shown in FIG. 8*a* and has been disclosed in the Japanese Patent Laid-open Application No. 62-276097/1987, taken along a warp thereof 17 of FIG. 8*a*.

In FIGS. 8*a* and 8*b*, wefts 1, 2, 3 to 14 represent lower wefts; wefts 1', 2', 3' to 14' represent upper wefts. In this repeated unit design, the lower wefts 1 and 7 are respectively interwoven with the warp 17, and the upper wefts 4' and 5' 11' and 12' are interwoven with the warp 17.

A cross point between a warp and a weft is referred to as a knuckle. The position of a warp placed on the same side of wefts across two knuckles is referred to as a crimp. For example, a knuckle 19 is formed at the point 1 of lowest weft, and a crimp 18 is formed across the knuckles of interweaving points of upper wefts 4' and 5' (hereinbelow, knuckles will be expressed such as a knuckle 4' and knuckle 5' . . . ).

The magnitude of the force, by which a knuckle of a warp on the paper side is withdrawn downward to the machine side, is in reverse proportion to the distance between the knuckle and the subsequent knuckle interwoven with a lower weft.

As is apparent from FIG. 8*b*, there is a distance of two weft counts between the crimp 18 formed by upper wefts 4' and 5' and the knuckle 1, and there is a distance of one weft count between same crimp 18 and the knuckle 7. Further, there is a distance of three weft counts between the knuckle 7 and the crimp 18 formed by upper wefts 11' and 12', and there is a distance of two weft counts between the same crimp 18 and the knuckle 1 of the subsequent design unit.

Accordingly, three types of knuckles different in distance between the knuckles and crimps are formed in a repeating design unit. For this reason, since each of crimps of the warp is withdrawn downward from the paper side to the machine side by the different force, the withdrawn or bending angles of the warp is also varied, so that the elevation or level and the shape of each of the knuckles varies, resulting in the difference of the shape of each of the crimps. That is, two kinds of crimps different in height are formed, namely, the crimp between upper wefts 4' and 5' and the crimp between upper wefts 11' and 12' are different in height. The closer the positions of the warp interwoven with a pair of wefts are, the steeper the warp turns. Thus, the paper side of the fabric becomes uneven and the wire marks are formed on the paper made by the fabric. As a result, the fabric disclosed in the Japanese Patent Laid-open Application No. 62-276097/1987 is disadvantageous in that it is useful only to make paper not being required to have smooth surfaces in which the wire marks have no effect on the quality thereof, so that the problem of the wear is not completely solved in a practical way.

As mentioned above, although various approaches to improve the wear resistance of the fabric have been proposed, none of them are sufficient to achieve a satisfactory level of wear resistance in a paper-making environment.

SUMMARY OF THE INVENTION

The first aspect of the present invention is a paper-making fabric having a repeating design unit with fourteen yarns or more for each of the warps, upper wefts and lower wefts, wherein the repeating design unit has a starting point where a lower weft is interwoven with a warp. A feature of the first aspect above is that a lower weft is interwoven with the warp once or twice, the adjacent two upper wefts are interwoven with the warp twice, the numbers of wefts disposed between positions of the warp interweaving the lower weft and the adjacent two upper wefts are equal to each other, and the warp travels between the upper and lower wefts, without interweaving any of wefts, in a substantially linear manner between two positions of the adjacent two upper wefts being interwoven with the warp.

The second aspect of the present invention is a fabric as described above, wherein a lower weft is interwoven with the warp once, the adjacent two upper wefts are interwoven with the warp twice, and, between positions of the warp interweaving the lower weft and the adjacent two upper wefts, two pairs of the upper and lower wefts are placed.

The third aspect of the present invention is a fabric as described above, wherein a lower weft is interwoven with the warp twice, the adjacent two upper wefts are interwoven with the warp twice, and, between the positions of the warp interweaving the lower weft and the adjacent two upper wefts, one pair of the upper and lower wefts is placed.

The fourth aspect of the present invention is a fabric as described above wherein a lower weft is interwoven with the warp twice, the adjacent two upper wefts are interwoven with the warp twice, and the positions of the warp interweaving the lower weft and the adjacent two upper wefts are adjacent to each other with no weft present therebetween.

The fifth aspect of the present invention is a fabric wherein the adjacent two lower wefts are interwoven with the warp once, the adjacent two upper wefts are interwoven with the warp twice, and, between the positions of the warp interweaving the adjacent two lower wefts and the adjacent two upper wefts, two pairs of the upper and lower wefts are placed.

The sixth aspect of the present invention is a fabric further including auxiliary wefts each located between adjacent upper wefts, wherein the auxiliary weft disposed between the adjacent two upper wefts interwoven with the warp is arranged below the warp.

The seventh aspect of the present invention is a fabric further including auxiliary wefts each located between adjacent upper wefts, wherein an auxiliary weft disposed between adjacent two upper wefts interwoven with the warp is arranged above the warp, while an auxiliary weft located between adjacent two upper wefts, one of which is interwoven and the other of which is not interwoven by the warp, is arranged under the warp.

The eighth aspect of the present invention is a fabric wherein lower wefts form a long crimp consisting of at least a twelve-warp distance.

The ninth aspect of the present invention is a fabric wherein a lower weft is larger in diameter than an upper weft.

The tenth aspect of the present invention is a fabric wherein an auxiliary weft is smaller in diameter than an upper weft.

Operations of the present invention will be described by showing features of the weaves in each repeating design unit of fabrics.

The first feature of the present invention is to provide a fabric in which a lower weft is interwoven with a warp once or twice, and adjacent two upper wefts are interwoven with the warp twice in each repeating design unit. Accordingly, the repeating design unit has two positions of the warp interweaving the adjacent two upper wefts on the paper side and has at least one position of the warp interweaving the lower weft on the machine side.

Distances between the interwoven positions on the paper side and the machine side are equal to each other. The warp forming the paper side, i.e., positions of the warp forming crimps on the paper side by interweaving the adjacent two upper wefts are lifted by two pairs of wefts, while at least one position of the warp interweaving the lower weft on the machine side is withdrawn downward by a pair of wefts. For this reason, the positions of the warp interweaving the adjacent two upper wefts on the paper side have a great tendency to bend downward. In addition, the magnitude of the force, by which the warp on the paper side is withdrawn to the machine side, varies in reverse proportion to a distance between one of the two positions on the paper side and the position on the machine side.

Accordingly, if the distances between the two interwoven positions on the paper side and on the machine side are equal to each other in the repeating design unit, the same force for withdrawing the warp from the paper side to the machine side is imposed on the warp at the same angler so that the paper side of the fabric becomes such a flat surface as to avoid the wire marks, thus improving the smoothness of the surface of the resultant paper. Whether the distances between the two positions on the paper side and the at least one position on the machine side are equal to each other is determined by the number of wefts present therebetween.

According to the second feature of the present invention, the number of pairs of the wefts formed between positions of the warp interweaving the adjacent two upper wefts and the lower weft is not important as long as the number thereof is equal to each other even though there is no yarn therebetween, i.e., as long as the distance therebetween is equal to each other.

The third feature of the present invention is to provide auxiliary wefts. Each of the auxiliary wefts is located between the adjacent upper wefts. An auxiliary weft placed between two adjacent upper wefts woven into the fabric by a warp is interwoven with the warp at this position. By using of the auxiliary wefts, the paper side surface becomes further flat. In addition, since the auxiliary wefts are woven into the repeating design unit of the fabric once, it is not a kind of a floating yarn to vary the space proportion by shifting positions.

The fourth feature of the present invention is to form a long crimp being under at least twelve warps on the machine side.

Accordingly, the long crimp increases an effective wearing volume of the fabric and permits the use of yarns having larger diameter, which is advantageous in view of improving the wear resistance.

As mentioned above, according to the present invention, the wear resistance can be improved without degrading the smoothness of the surface of the fabric for use in paper machines, and without increasing the wire marks of the resultant paper. Next, preferred embodiments of the present invention will be specifically described in comparison with the conventional fabrics according to the accompanying drawings.

PREFERRED EMBODIMENTS

Figure 5A:
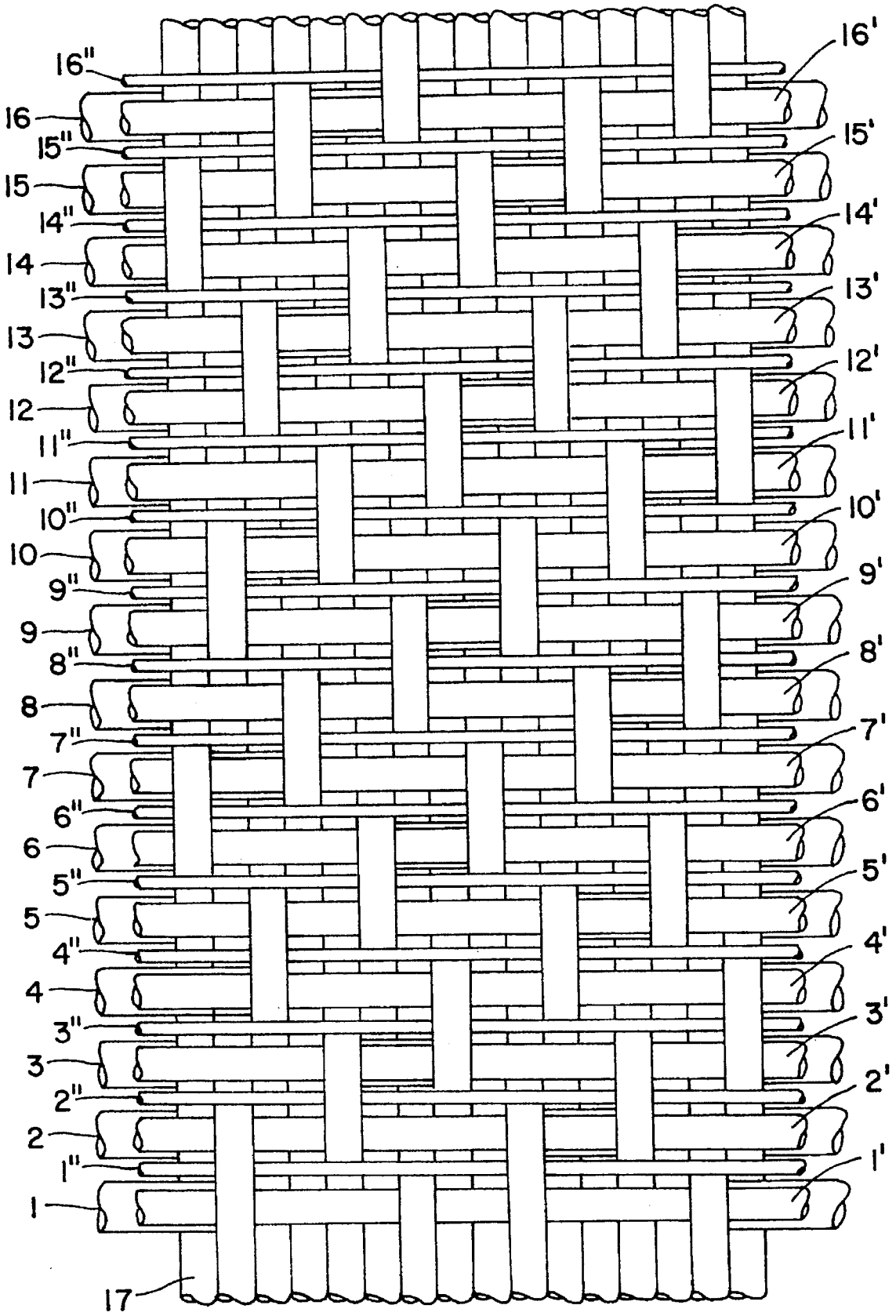
FIG. 5*a* is a plan view of a repeating design unit of a 16-shaft paper-making fabric according to a fifth embodiment of the present invention.
Figure 5B:
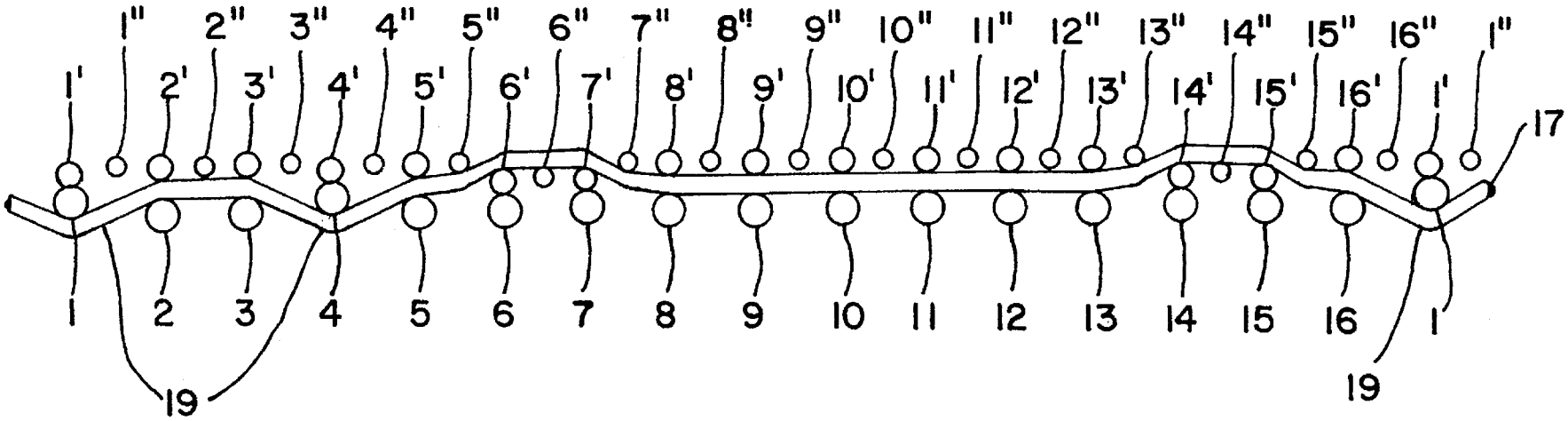
FIG. 5*b* is a cross sectional view of the repeating design unit of the fabric shown in FIG. 5*a* taken along a warp 17 thereof.
Figure 6A:
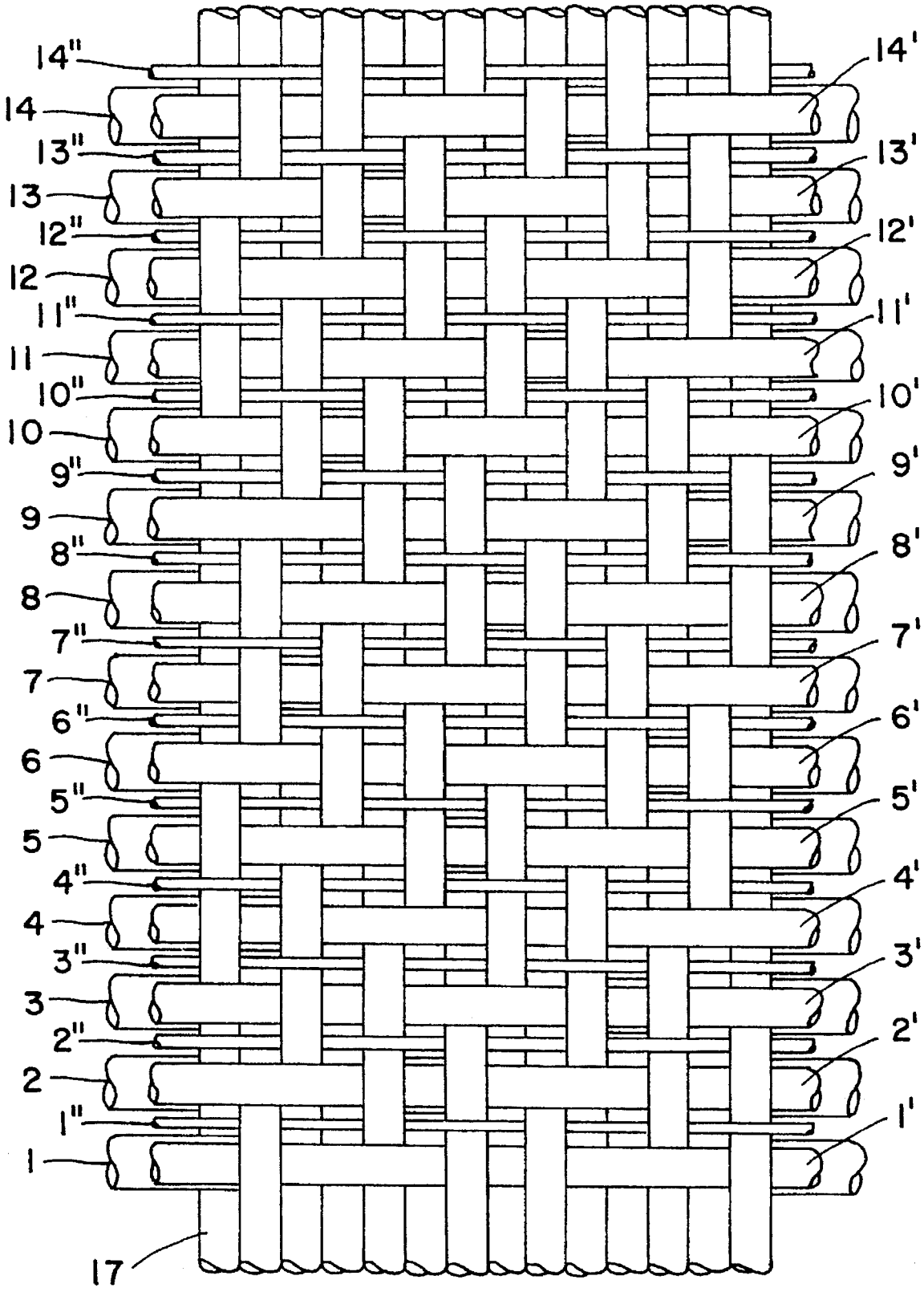
FIG. 6*a* is a plan view of the repeating design unit of a 14-shaft paper-making fabric according to a sixth embodiment of the present invention.
Figure 6B:
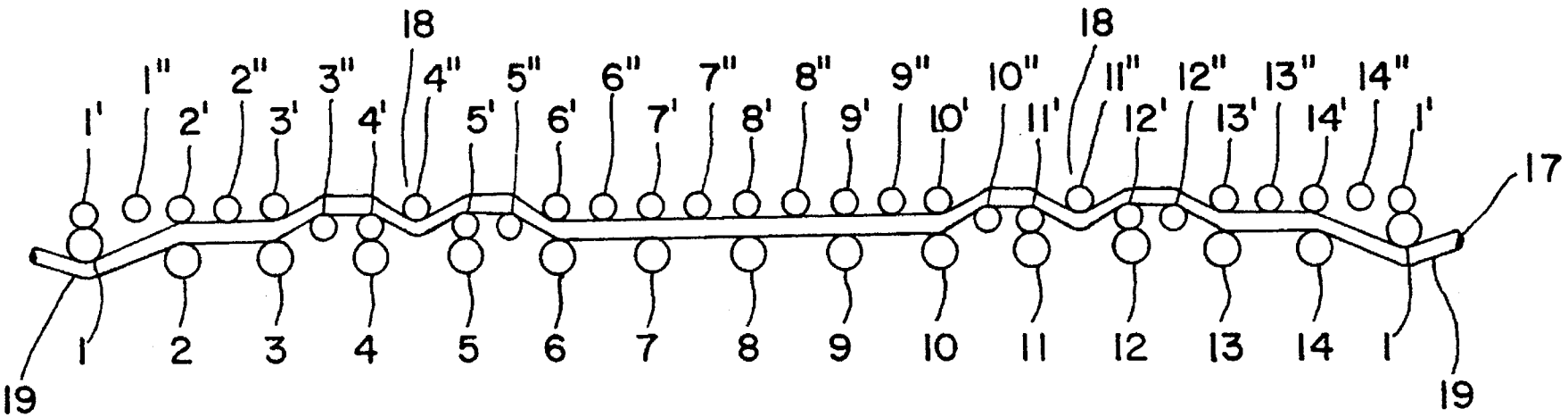
FIG. 6*b* is a cross sectional view of the repeating design unit of the fabric shown in FIG. 6*a* taken along a warp 17 thereof.

FIGS. 1*a* through 6*a* are plan views of and FIGS. 16 through 6*b* are cross sectional views of a repeating design units of fabrics according to six preferred embodiments of the present invention, each taken along a warp thereof. Referring to the drawings, the structures of fabrics which correspond to the embodiments will be described in both paper side and machine side of the fabrics.

FIGS. 7*a*, 7*b*, 8*a* and 8*b* show conventional fabrics.

The conventional fabrics are described first to facilitate an understanding of the present invention.

Figure 7A:
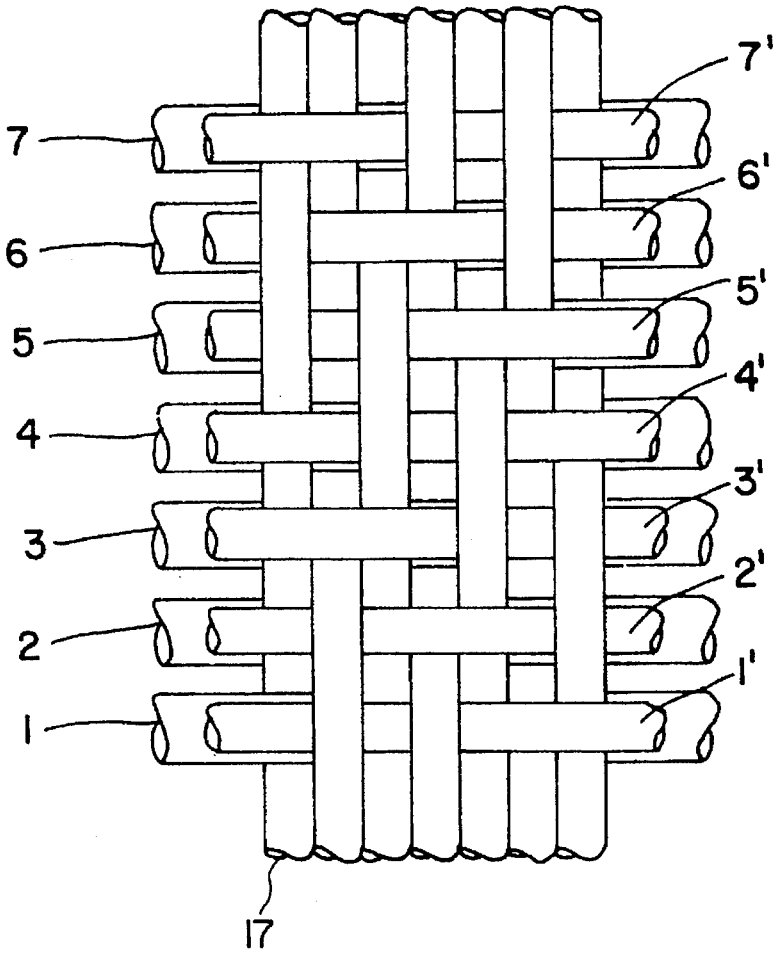
FIG. 7A PRIOR ART
FIG. 7*a* is a plan view of the repeating design unit of a conventional seven-shaft paper-making fabric.
Figure 7B:
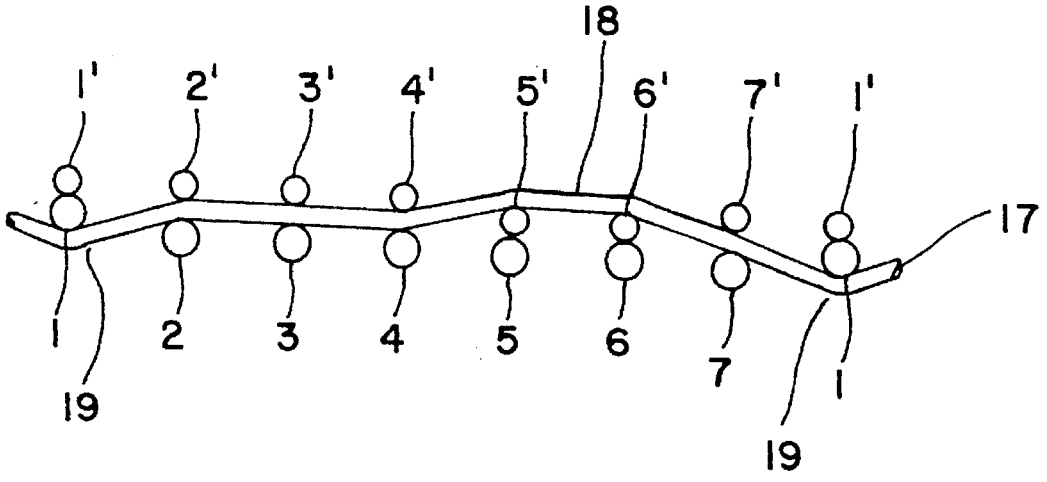
FIG. 7B PRIOR ART
FIG. 7*b* is a cross sectional view of the repeating design unit of a conventional fabric shown in FIG. 7*a* taken along a warp 17 thereof.

FIGS. 7*a* and 7*b* show a repeated design unit of the fabric of seven shaft formed of seven pairs of wefts and seven warps. In FIGS. 7*a* and 7*b*, upper wefts extended on the paper side of the fabric represent reference numerals 1' through 7'; lower wefts extended on the machine side of the fabric represent reference numerals 1 through 7; a warp represents reference numeral 17. When a warp passes over or underneath a pair of upper and lower wefts, this condition is referred to herein as the wefts being interwoven into a fabric Accordingly, pairs of wefts 1 and 1' 5 and 5' and 6 and 6' are interwoven into the fabric with the warp 17. The warp 17 travels between pairs of lower and upper wefts 2 and 2' through 4 and 4', and 7 and 7', rather than being interwoven therewith. On the paper side, the surface of the fabric is formed of the upper wefts 1' through 4' and 7', and the warp part placed on the upper wefts 5' and 6', so that a crimp 18 corresponding to two weft counts is formed. On the machine side, the surface of the fabric is formed of the lower wefts 2 through 7, and a knuckle 19 is formed by the warp 17 under the lower weft 1.

According to the fabric shown in FIGS. 7*a* and 7*b*, in a seven-shaft repeating design unit consisting of seven pairs of wefts and seven warps, the lower weft 1 is interwoven with the warp 17 once, and upper wefts 5' and 6' are interwoven with the warp 17 once. In addition, the distance between the lower weft 1 and the upper weft 5' is different from the distance between the upper weft 6' and a lower weft 1 of a subsequent design unit.

Accordingly, the warp 17 is bent at different angles in different positions of the wefts and is increased in the number of turns, so that the paper side of the fabric is no longer smooth or flat. Furthermore, this conventional fabric is a seven-shaft weave, and the lower weft is interwoven with the warp once in the repeating design unit, so that the end of the lower wefts forms one crimp in a repeating unit and is extended under only six warps on the machine side of the fabric, thus having a considerable weakness with respect to wear resistance of the fabric.

Figure 8A:
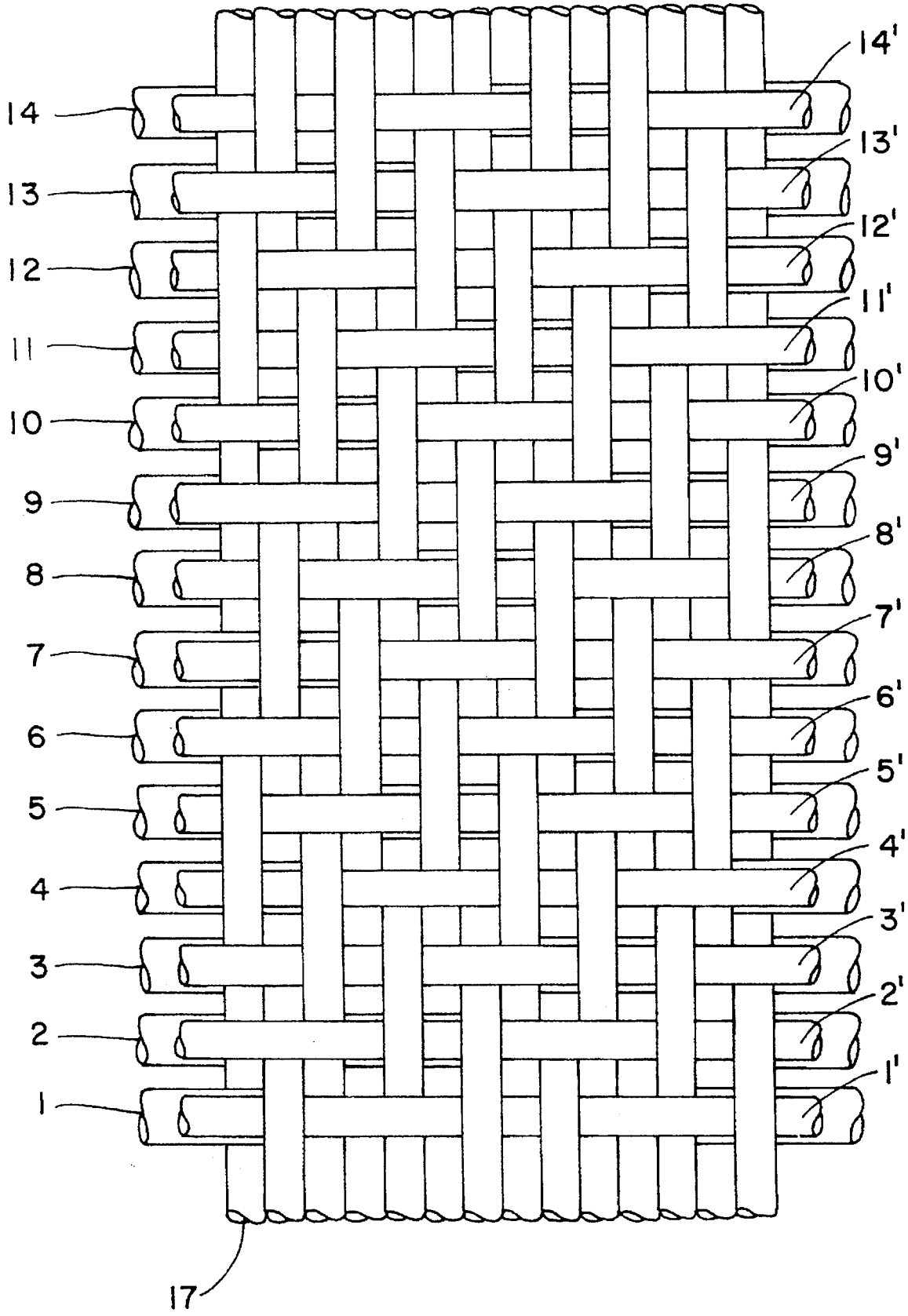
FIG. 8A PRIOR ART
FIG. 8*a* is a plan view of the repeating design unit of a conventional 14-shaft paper-making fabric.
Figure 8B:
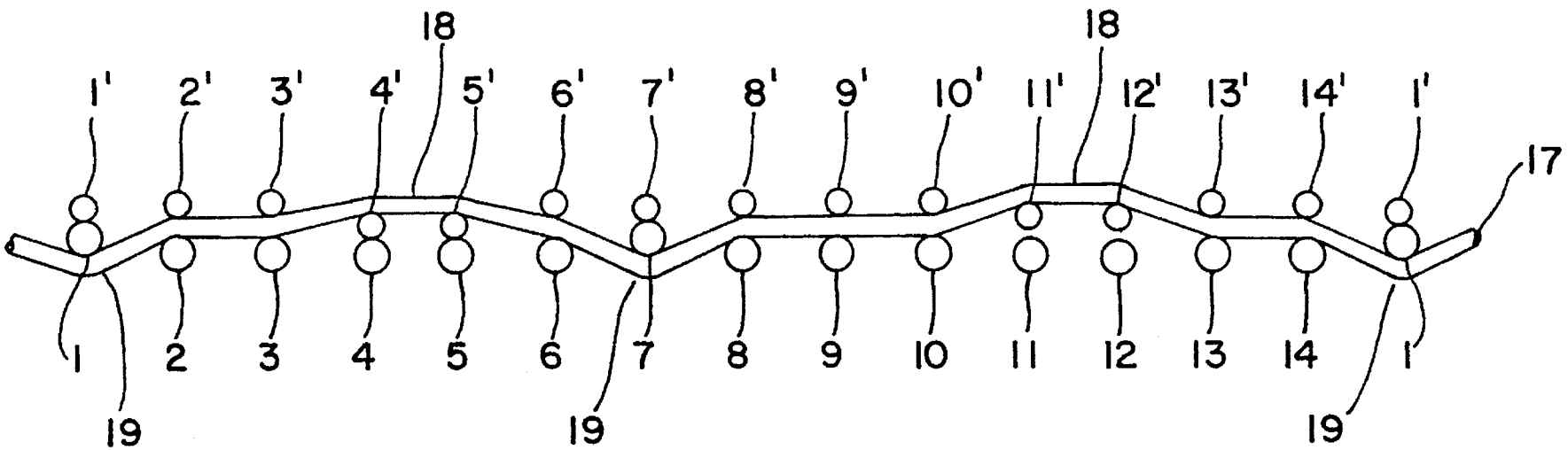
FIG. 8B PRIOR ART
FIG. 8*b* is a cross sectional view of the repeating design unit of another conventional fabric shown in FIG. 8*a* taken along a warp 17 thereof.

FIGS. 8*a* and 8*b* show a conventional 14-shaft fabric disclosed in the Japanese Laid-open Patent Application No. 62-276097/1987 as described above. In this fabric, there are two crimps 18 formed on the paper side and two crimps 19 formed on the machine side in a repeating design unit. There also are three kinds of distances along with a warp, i.e., one weft count (e.g. between wefts 5' and 7), two weft counts (e.g. between wefts 1 and 4'), and three weft counts (e.g. between wefts 7 and 11'), between the positions where the warp is interwoven with the lower wefts 1 and 7 and the crimps 18. Then, the distance between the crimp 18 and knuckle 19 of a subsequent repeating design unit is two weft counts (e.g. between weft 12' and weft 1 of the subsequent unit). The magnitude of the force exerted on the warp 17 at the position interwoven with the lower weft 7 having a distance of one weft count to the crimp 18 formed by wefts 4' and 5' is far larger than that having a distance of three weft counts to the crimp 18 formed by the wefts 11' and 12'. Accordingly, the warp forming crimps 18 on the paper side is withdrawn downward by three kinds of forces different in magnitude in the repeating design unit, so that each angle of the warp turns varies, resulting in the differences in heights and shape of the crimps.

As mentioned above, the fabric is formed by alternatively disposing two types of crimps different in shape of turns and level of crimps in the direction of the warp, so that the paper side surface of the fabric cannot be smooth and flat.

Figure 1A:
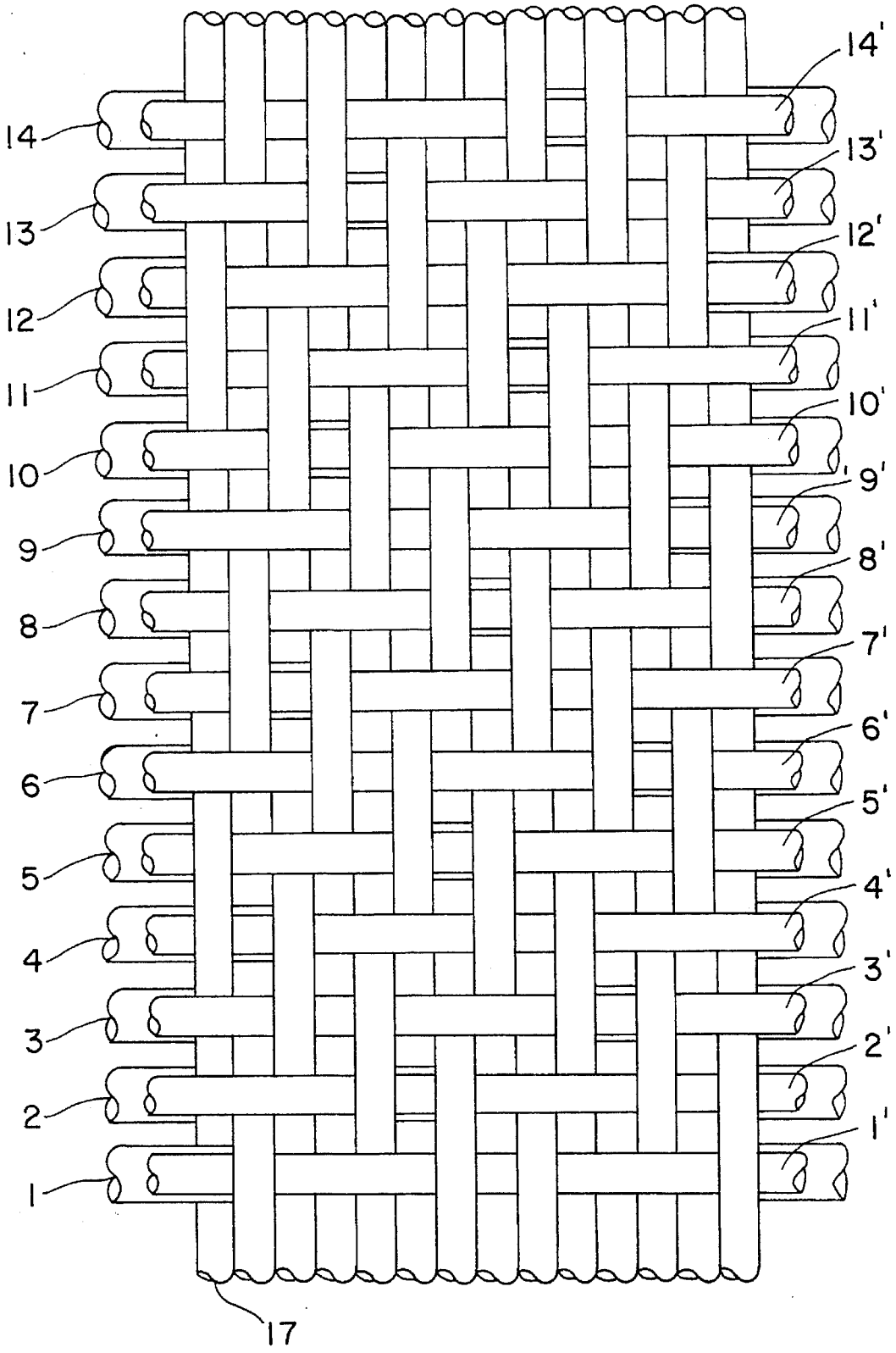
FIG. 1*a* is a plan view of a repeating design unit of a 14-shaft paper-making fabric according to a first embodiment of the present invention.
Figure 1B:
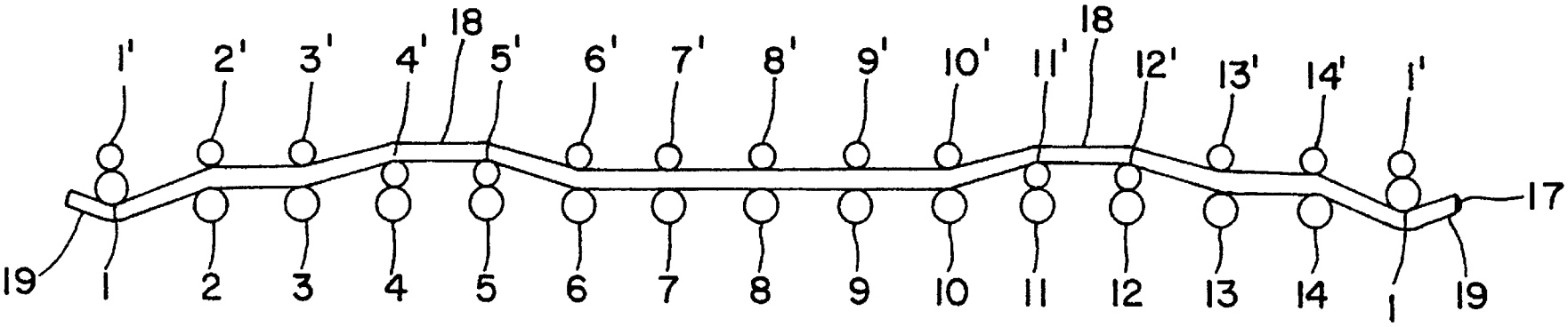
FIG. 1*b* is a cross sectional view of the repeating design unit of the fabric shown in FIG. 1*a* taken along a warp 17 thereof.

FIGS. 1 and 1*b* show a first embodiment of the present invention, in which a 14-shaft double layer weave fabric forms a repeating design unit with 14 yarns for each of warps, upper wefts 1' through 14' and lower wefts 1 through 14. In the repeating design unit of the 14-shaft fabric shown in FIGS. 1*a* and 1*b*, two crimps 18 are formed on the paper side by the adjacent two upper wefts interwoven with the warp 17. In the repeating design unit starting from the upper weft 4' of FIG. 1*b*, the first crimp 18 on the paper side is formed by the adjacent two upper wefts 4' and 5' interwoven with the warp 17, the second crimp 18 on the paper side is formed by the adjacent two upper wefts 11' and 12' and a knuckle 19 on the machine side is formed by the lower weft 1 interwoven with the warp 17. The warp 17 travels between the wefts from the first crimp 18 to the second crimp 18 for five counts of the upper wefts 6', 7', 8', 9' and 10' (corresponding to the lower wefts 6, 7, 8, 9 and 10) and also extends from the second crimp 18 to the first crimp 18 for five counts of the upper wefts 13', 14', 1', 2' and 3' (corresponding to the lower wefts 13, 14, 1, 2 and 3). In other words, the crimps on the paper side are away from each other at an equal distance of five weft counts.

The repeating design unit also has one knuckle 19 on the machine side formed by the warp 17 interwoven with the lower weft 1. More specifically, the knuckle 19 is formed in a length of the warp 17 for five counts of the upper wefts 13', 14', 1', 2' and 3'. On the other hand, another length of the warp 17 for five counts of the upper wefts 6', 7', 8', 9' and 10' has no knuckle on the machine side and the warp 17 merely travels between the upper and lower wefts. Distances between the knuckle 19 on the machine side and the two crimps 18 on the paper side, which have a possibility of making an uneven surface on the paper side, are equal to each other. That is, a distance between the knuckle 19 and the first crimp 18 formed by the adjacent two upper wefts 4' and 5' is equal to two counts of the upper wefts 2' and 3' (corresponding to the lower wefts 2 and 3), and a distance between the knuckle 19 and the second crimp 18 formed by the adjacent two upper wefts 11' and 12' is equal to two counts of the upper wefts 13' and 14' (corresponding to the lower wefts 13 and 14). In other words, both distances are equal to two counts of wefts. The warp 17 is not withdrawn downward between the two crimps 18, so that no uneven surface is formed on the fabric at this section.

Accordingly, the same force is imposed on the warp 17 at the same angle for all crimps. As shown in FIG. 1*b*, there is no difference in the elevation of the crimps 18 on the paper side and no difference in the shape of the knuckles 19, in comparison with the conventional fabric having two kinds of crimps on the paper side, in which there is a difference in distance between the knuckle on the machine side and each crimp on the paper side, described in FIGS. 8*a* and 8*b*.

In addition, the lower weft is interwoven with the warp 17 only once for each repeating design unit, so that the warp 17 travels between the knuckle 19 and the subsequent knuckle 19 for a 13 count length. That is, the lower wefts form a long crimp on the machine side of the fabric that is extended under thirteen warps.

This permits improvement of the wear resistance without degrading the smoothness of the surface of the fabric.

Figure 2A:
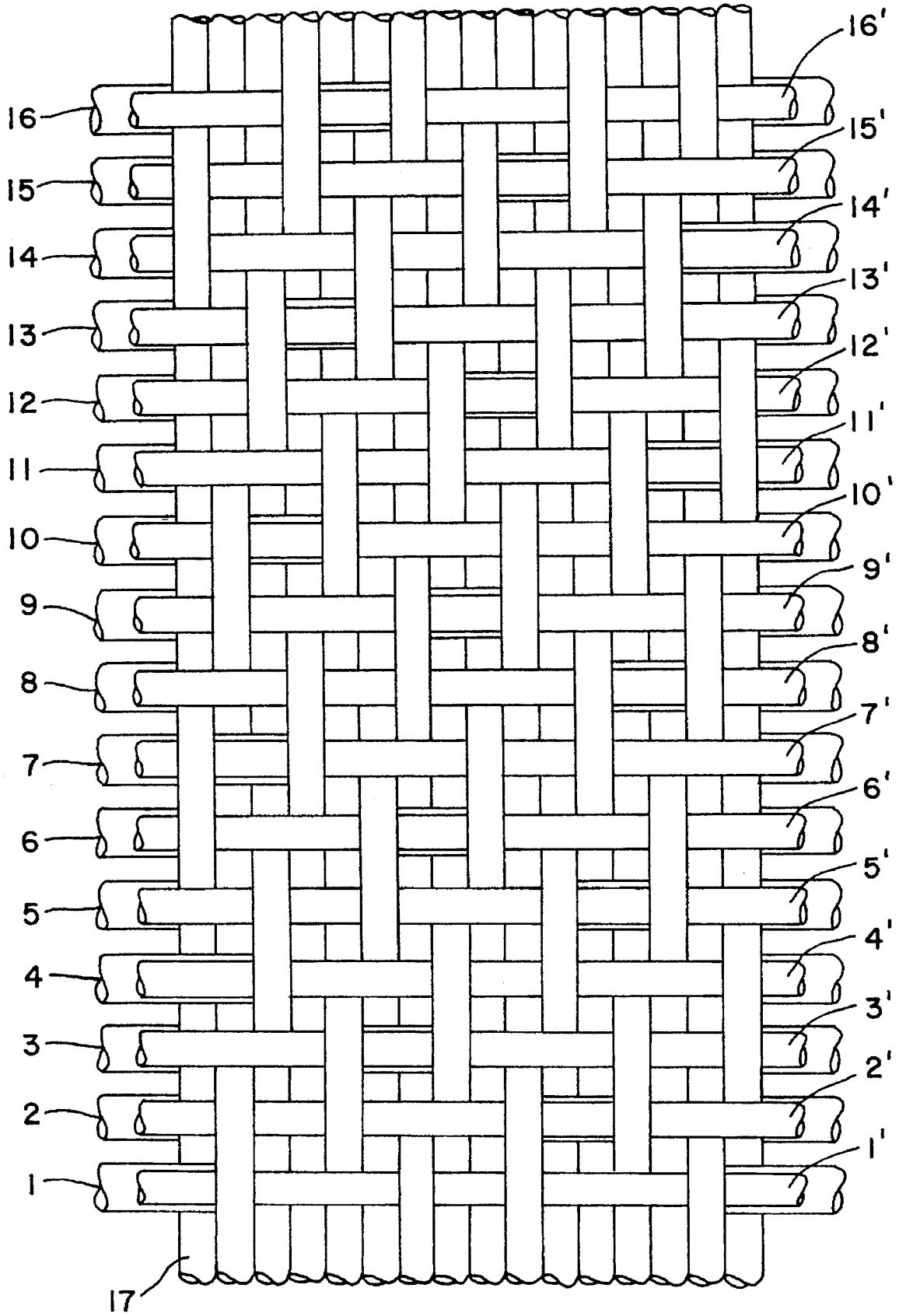
FIG. 2*a* is a plan view of a repeating design unit of a 16-shaft paper-making fabric according to a second embodiment of the present invention.
Figure 2B:
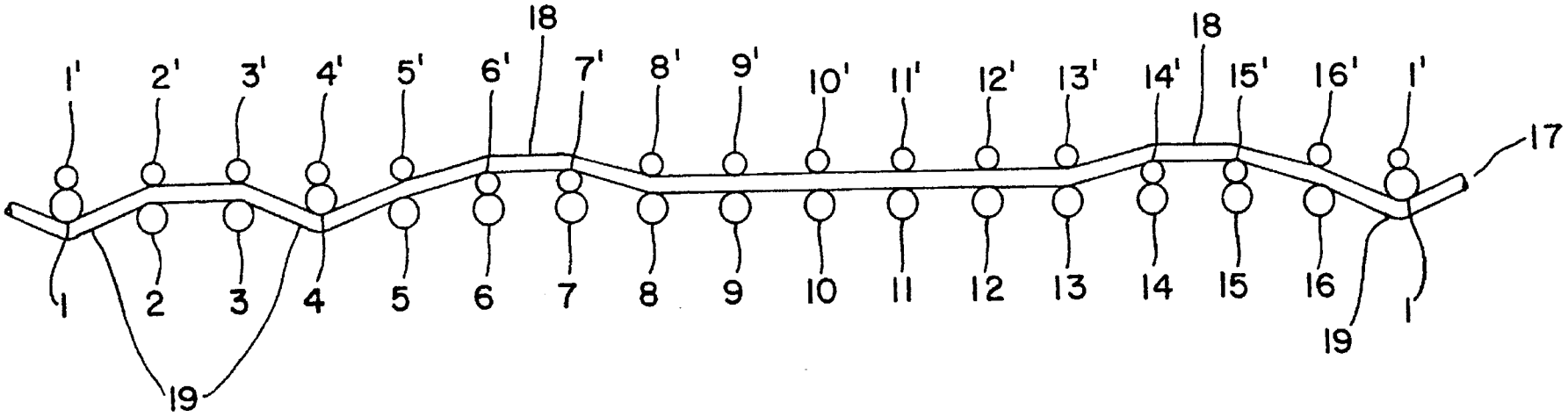
FIG. 2*b* is a cross sectional view of the repeating design unit of the fabric shown in FIG. 2*a* taken along a warp 17 thereof.

FIGS. 2*a* and 2*b* show a second embodiment of the present invention, in which a 16-shaft double layer weave fabric forms a repeating design unit with 16 yarns for each of warps, upper wefts 1'–16' and lower wefts 1–16. In the repeating design unit shown in FIGS. 2*a* and 2*b*, two crimps 18 are formed on the paper side by the adjacent two upper wefts interwoven with the warp 17. The first crimp 18 is formed on the paper side by the adjacent two upper wefts 6' and 7' interwoven with the warp 17. The second crimp 18 on the paper side is formed by adjacent two upper 14' and 15' interwoven with the warp 17. After the warp 17 interweaves the lower weft 1, it goes between two pairs of wefts 2, 2' and 3, 3', and then the warp 17 interweaves the lower weft 4. Thus, the repeating design unit shown in FIGS. 2*a* and 2*b* has two knuckles 19 on the machine side. Assuming that a repeating design unit starts from the upper weft 6' by the consideration of a distance between the crimps, it will be understood that the crimps on the paper side are away from each other at an equal distance of six yarn counts. That is, the warp 17 travels between the wefts from the first crimp 18 to the second crimp 18 for six counts of the upper wefts 8', 9', 10', 11', 12' and 13' (corresponding to the lower wefts 8, 9, 10, 11, 12 and 13) and also extends from the second crimp 18 to the first crimp 18 for six counts of the upper wefts 16', 1', 2', 3', 4' and 5' (corresponding to the lower wefts 16, 1, 2, 3, 4' and 5).

In addition, the two knuckles 19 on the machine side are formed between the two crimps 18 in a half portion of the warp 17 in a repeating design unit for six counts of the upper wefts 16', 1', 2', 3', 4' and 5'. On the other hand, no knuckle is formed on the machine side between the crimps 18 in another half portion of the warp 17 for six counts of the upper wefts 8', 9', 10', 11', 12' and 13', and the warp 17 merely travels between the upper and lower wefts 8' through 13' and 8 through 13.

A distance between the knuckle 19 interwoven with the lower weft 4 and the first crimp 18 formed by the adjacent two upper wefts 6' and 7' is equal to one count of the upper wefts 5' (corresponding to the lower wefts 5), and a distance between the second crimp 18 formed by the adjacent two upper wefts 14' and 15' and the knuckle 19 interwoven with the lower weft 1 is equal to one count of the upper wefts 16' (corresponding to the lower wefts 16). In other words, both distances are equal to one count of weft.

In addition, the lower wefts are interwoven with the warp 17 twice for each repeating design unit, so that it is provided with a long crimp of 14-count.

Accordingly, the second embodiment permits improvement of the wear resistance without degrading the smoothness of the surface of the fabric as well as the first embodiment.

Other embodiments of the present invention described hereinbelow are similar in design to the above mentioned first and second embodiment. Accordingly, following description is made briefly.

Figure 3A:
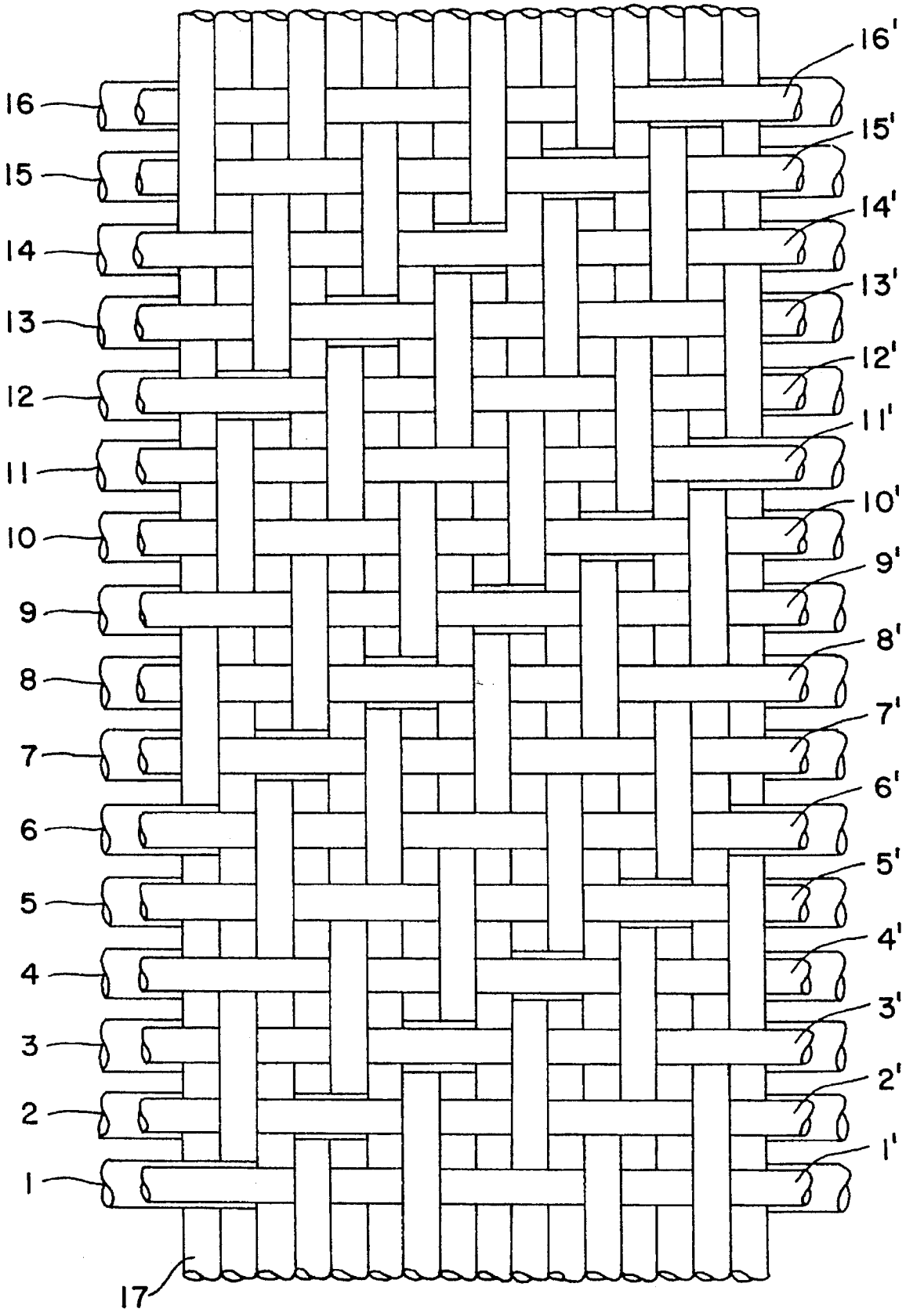
FIG. 3*a* is a plan view of a repeating design unit of a 16-shaft paper-making fabric according to a third embodiment of the present invention.
Figure 3B:
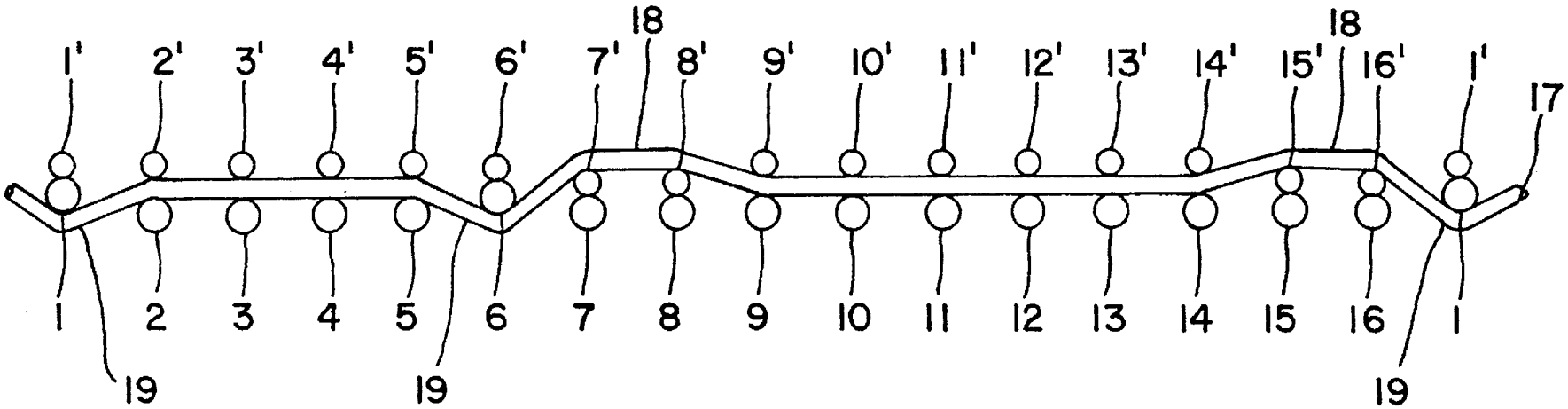
FIG. 3*b* is a cross sectional view of the repeating design unit of the fabric shown in FIG. 3*a* taken along a warp 17 thereof.

A third embodiment of a 16-shaft double layer weave fabric shown in FIGS. 3*a* and 3*b* is similar to the second embodiment shown in FIG. 5 except that each of knuckles 19 is placed adjacent to each crimp 18 (the first crimp 18 or the second crimp 18) and no weft is interposed therebetween. In this embodiment, the warp 17 is interwoven with the adjacent two upper wefts 7' and 8' to form the first crimp 18 on the paper side. The warp 17 is also interwoven with the adjacent two upper wefts 15' and 16' to form the second crimp 18 on the paper side. After the warp 17 interweaves the lower weft 1, it goes between the upper wefts 2', 3', 4' and 5', and the lower wefts 2, 3, 4 and 5, and then it interweaves the lower weft 6. Thus, the repeating design unit has two knuckles 19 on the machine side. Accordingly, a distance between each knuckle 19 and the adjacent crimp 18 is equal to no weft count.

In addition, the lower wefts are interwoven with the warp 17 twice for each repeating design unit, so that it is provided with a long crimp of 14-count length.

This permits improvement of the wear resistance without degrading the smoothness of the surface of the fabric as well as the above-mentioned embodiments.

Figure 4A:
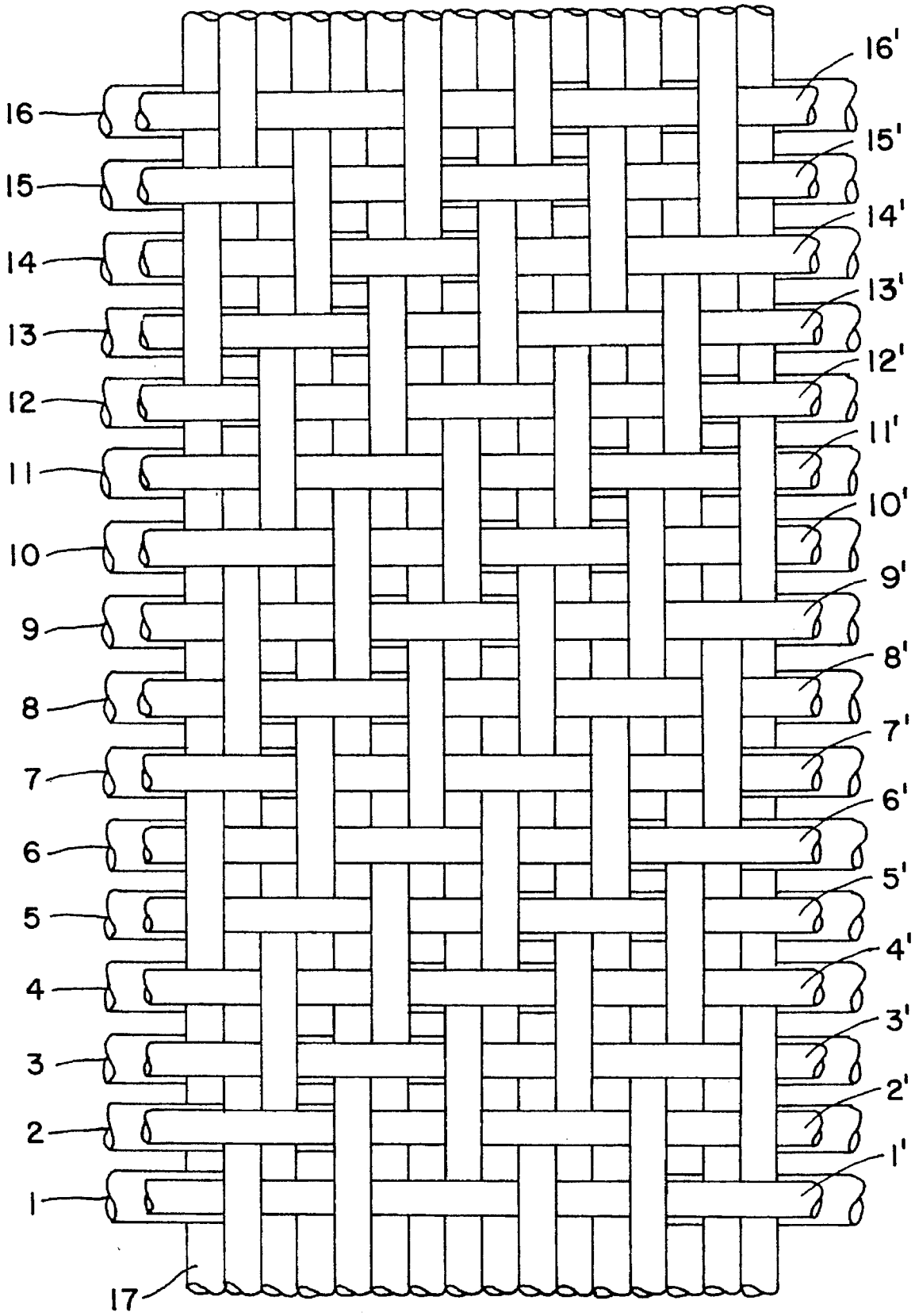
FIG. 4*a* is a plan view of a repeating design unit of a 16-shaft paper-making fabric according to a fourth embodiment of the present invention.
Figure 4B:
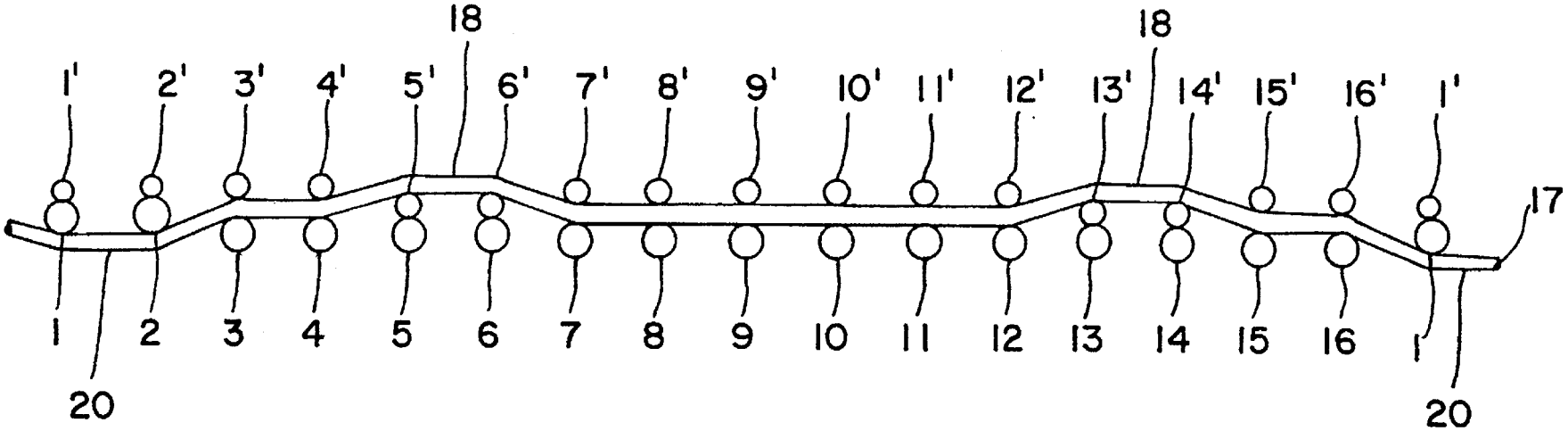
FIG. 4*b* is a cross sectional view of the repeating design unit of the fabric shown in FIG. 4*a* taken along a warp 17 thereof.

A fourth embodiment of the double layer weave fabric of 16 shaft shown in FIGS. 4*a* and 4*b* is similar to the third embodiment shown in FIGS. 3*a* and 3*b* except that a crimp 20 is formed on the machine side and no knuckle is formed in the repeating design unit. In this embodiment, the warp 17 is interwoven with the upper wefts 5' and 6' to form the first crimp 18 on the paper side. The warp 17 is also interwoven with the upper wefts 13' and 14' to form the second crimp 18 on the paper side. The crimp 20 is formed by the warp 17 interwoven with the lower wefts 1 and 2 on the machine side. The design has no knuckle and the warp 17 merely travels between pairs of wefts across the crimps 18 on the paper side and the crimp 20 on the machine side. A distance between the crimp 20 on the machine side and the first crimp 18 on the paper side is equal to two counts of the upper wefts 3' and 4', and a distance between the second crimp 18 and a crimp 20 of the subsequent repeating design unit is equal to two counts, so that both distances are equal to two weft counts. In addition, the lower weft is interwoven with the warp 17 once for each repeating design unit, so that it is provided with a long crimp of 14-count length is provided. Accordingly, the paper side of the fabric is smooth and the wear resistance is improved by the crimp of 14-count length on the machine side.

A fifth embodiment shown in FIGS. 5*a* and 5*b* is similar to the second embodiment shown in FIGS. 2*a* and 2*b* except that auxiliary wefts are disposed between respective upper wefts. As shown in FIGS. 5*a* and 5*b*, auxiliary wefts 1" through 16" are each adjacent to each of disposed upper wefts 1' through 16'. In the fifth embodiment shown in FIGS. 5*a* and 5*b*, the auxiliary wefts 6" and 14" are disposed between the upper wefts 6' and 7' and the upper wefts 14' and 15' respectively, and are interwoven by the warp 17 which also interweaves the upper wefts 6', 7', 14' and 15'. On the other hand, the auxiliary wefts 5", 7", 13" and 15" disposed between upper wefts 5' and 6', 7' and 8', 13' and 14' and 15' and 16' respectively are not interwoven by the warp 17.

The auxiliary wefts may be disposed between upper wefts shown in FIGS. 1*a* and 1*b*, FIGS. 3*a* and 3*b*, and FIGS. 4*a* and 4*b* in the same manner as shown in FIGS. 5*a* and 5*b*. These auxiliary wefts contribute to render the weave on the paper side dense, improving the smoothness of the surface.

FIGS. 6*a* and 6*b* show a sixth embodiment of the present invention, in which a 14-shaft double layer weave fabric forming a repeating design unit with 14 yarns for each of warps, upper wefts and lower wefts, as shown in FIGS. 1*a* and 1*b*, is disclosed. In this embodiment, each of auxiliary wefts is disposed between respective upper wefts. For each repeating design unit, two crimps 18 are formed at the portions of the warps 17 between auxiliary wefts 3" and 5" as well as between auxiliary wefts 10" and 12". After the warp 17 interweaves the auxiliary weft 3" and the upper weft 4' it goes under the auxiliary weft 4" and then it interweaves the upper weft 5' and the auxiliary weft 5", so that the first crimp 18 is formed on the paper side. On the other hand, after the warp 17 interweaves the auxiliary weft 10" and the upper weft 11' it goes under the auxiliary weft 11" and then it interweaves the upper weft 12' and the auxiliary weft 12", so that the second crimp 18 is formed on the paper side. The repeating design unit has one knuckle 19 on the machine side of the repeating design unit formed by the warp 17 interwoven with the lower weft 1. A distance between the knuckle 19 on the machine side and each crimp 18 (the first crimp 18 or the second crimp 18) on the paper side is equal to two weft counts. In the right side of FIG. 6*b*, the distance corresponding to two weft counts is a distance between the second crimp 18 and a knuckle 19 of the subsequent repeating design unit.

In addition, the warp 17 is interwoven with a weft 17 only once for each repeating design unit, so that the warp 17 travels between the knuckle 19 and the knuckle 19 of the subsequent unit for 13 count length, i.e., a crimp of 13-count length is formed.

In the sixth embodiment shown in FIGS. 6*a* and 6*b*, the auxiliary wefts 4– and 11" are disposed between the upper wefts 4' and 5' and the upper wefts 11' and 12' respectively, and are not interwoven by the warp 17 which interweaves the upper wefts 4' 5' 11' and 12' On the other hand, the auxiliary wefts 3", 5", 5" and 12" disposed between upper wefts 3' and 4', 5' and 6', 10' and 11' and 12' and 13' respectively are interwoven by the warp 17.

The auxiliary wefts may be disposed between the embodiments shown in FIGS. 2*a* and 2*b*, FIGS. 3*a* and 3*b*, and FIGS. 4*a* and 4*b* in the same manner as shown in FIGS. 6*a* and 6*b*.

Accordingly, this permits improvement of the wear resistance without degrading the smoothness of the surface of the fabric as well as the above-mentioned embodiments.

As mentioned above, according to the present invention, it becomes possible to improve the smoothness of the surface of fabric, especially the fabric which is useful for paper-making thereby reduces the wire marks of the resultant paper, while the wear resistance of the fabric is also improved.

Any yarn used for the present invention may be either polyester or polyamide monofilament. To increase the wear resistance of a fabric, polyamide monofilament is useful. To increase the stability of a fabric, polyester monofilament is useful. To balance both the wear resistance and stability of the fabric, combination of polyester and polyamide monofilament are useful, particularly for lower wefts of the fabric.

The lower wefts of the present invention may be larger in diameter than the upper wefts to increase the wear resistance. The auxiliary wefts of the present invention may be smaller in diameter than the upper wefts to increase the smoothness of the paper side of the fabric and the smoothness of resultant papers made by the present invention.

Surface smoothness and the wear resistance of the present invention will be particularly shown by comparing examples of the present invention with those of the conventional fabrics. In Table 1 below, the first and sixth embodiments respectively shown in FIGS. 1*a* and FIG. 1*b* and FIGS. 6*a* and 6*b* are used as representative examples of the present invention as examples 1 and 6 respectively, whereas the conventional fabrics shown in FIGS. 7*a* and 7*b* and FIG. 8*a* and 8*b* are used as comparison examples 1 and 2 respectively. As for the lower wefts of the example 6, polyester monofilaments and polyamide monofilaments are disposed in turn.

TABLE 1

| | | Example 1 16 | Example 6 14 | Comparison 1 7 | Comparison 2 14 |
|---|---|---|---|---|---|
| Warp | Material | PET | PET | PET | PET |
| | Diameter(mm) | 0.17 | 0.17 | 0.17 | 0.17 |
| | Density (Number/Inch) | 155 | 155 | 155 | 155 |
| Upper Weft | Material | PET | PET | PET | PET |
| | Diameter(mm) | 0.20 | 0.20 | 0.20 | 0.20 |
| | Density (Number/Inch) | 60 | 45 | 60 | 60 |
| Auxiliary Weft | Material | | PET | | |
| | Diameter(mm) | | 0.17 | | |
| | Density (Number/Inch) | | 45 | | |
| Lower Weft | Material | PET,PA | PET,PA | PET,PA | PET,PA |
| | Diameter(mm) | 0.30 | 0.30 | 0.22 | 0.30 |
| | Density (Number/Inch) | 60 | 45 | 60 | 60 |
| Smoothness (Second) | | 93 | 98 | 92 | 81 |
| Lifetime Number Ratio | | 100 | 93 | 56 | 95 |

Note to Table 1:

PET: Polyester monofilament.

PA: Polyamide monofilament.

Smoothness:

Smoothness was determined in a following manner. The stock was prepared from refibrillized old newspaper. Sheet paper samples each having a basis weight of 70 $g/m^2$ were formed by using a standard sheet former of the Technical Association of Pulp and Paper Industry (TAPPI). Smoothness of the paper faced to the paper side of the weave was measured by using a Bekk smoothness tester. The resultant larger value indicates more smoothness the paper surface.

Lifetime Number Ratio:

Lifetime Number Ratio was determined by using a wear resistance tester of Japanese Utility Model Registration No. 1350122, NIPPON FILCON Co., Ltd.

As apparent from the above, since the double layer weave fabric for paper-making of the present invention exhibits a smooth paper side, the fabric can be used to make paper having smooth surface with no wire mark. The fabric of the present invention further exhibits high wear resistance.

What is claimed is:

1. A paper-making fabric having a plurality of repeating design units, each of the repeating design units comprising fourteen yarns or more for each of warps, upper wefts and lower wefts, each of the upper wefts being extended in parallel over each of the lower wefts, wherein, in a first repeating design unit, a first lower weft being interwoven with a warp at a first position, a first and a second upper wefts which are adjacent to each other being interwoven with the warp at a third position, a third and a fourth upper wefts which are adjacent to each other being interwoven with the warp at a fourth position, further wherein the number of upper or lower wefts disposed between the first position and the third position and the number of upper or lower wefts disposed between the fourth position and the first position of a second repeating design unit subsequent to the first repeating design unit are the same, and the warp travels in a substantially linear manner between upper and lower wefts disposed between the third position and the fourth position.

2. A paper-making fabric having a plurality of repeating design units, each of the repeating design units comprising fourteen yarns or more for each of warps, upper wefts and lower wefts, each of the upper wefts being extended in parallel over each of the lower wefts, wherein, in a first repeating design unit, a first lower weft being interwoven with a warp at a first position, a third lower weft being interwoven with the warp at a second position, a first and a second upper wefts which are adjacent to each other being interwoven with the warp at a third position, a third and a fourth upper wefts which are adjacent to each other being interwoven with the warp at a fourth position, further wherein the number of upper or lower wefts disposed between the second position and the third position and the number of upper or lower wefts disposed between the fourth position and the first position of a second repeating design unit subsequent to the first repeating design unit are the same, and the warp travels in a substantially linear manner between upper and lower wefts disposed between the third position and the fourth position.

3. A fabric as set forth in claim 1, wherein the number is two, and the warp travels between upper and lower wefts disposed between the first and the third positions and between the forth position and the first position of the second repeating design unit.

4. A fabric as set forth in claim 2, wherein the number is one, and the warp travels between upper and lower wefts disposed between the second and the third positions and between the forth position and the first position of the second repeating design unit.

5. A fabric as set forth in claim 2, wherein the number is zero.

6. A fabric as set forth in claim 1, wherein a first lower weft and a second lower weft disposed adjacent to the first lower weft being interwoven with a warp at a first position, and further wherein the number is two, and the warp travels between upper and lower wefts disposed between the first and the third positions and between the forth position and the first position of the second repeating design unit.

7. A fabric as set forth in claim 1, further comprising auxiliary wefts, wherein each of the auxiliary wefts being disposed adjacent to each of the upper wefts.

8. A fabric as set forth in claim 2, further comprising auxiliary wefts, wherein each of the auxiliary wefts being disposed adjacent to each of the upper wefts.

9. A fabric as set forth in claim 7, auxiliary wefts disposed between the first and second upper wefts and between the third and fourth upper wefts being interwoven by the warp.

10. A fabric as set forth in claim 7, auxiliary wefts disposed between the first and second upper wefts or between the third and fourth upper wefts not being interwoven by the warp.

11. A fabric as set forth in claim 8, auxiliary wefts disposed between the first and second upper wefts and between the third and fourth upper wefts being interwoven by the warp.

12. A fabric as set forth in claim 8, auxiliary wefts disposed between the first and second upper wefts or between the third and fourth upper wefts not being interwoven by the warp.

13. A fabric as set forth in claim 1, the fabric comprising a paper side and a machine side, wherein said lower wefts forming a crimp on the machine side with an at least 12 warp-length.

14. A fabric as set forth in claim 2, the fabric comprising a paper side and a machine side, wherein said lower wefts forming a crimp on the machine side with an at least 12 warp-length.

15. A fabric as set forth in claim 1, wherein the lower wefts are larger in diameter than the upper wefts.

16. A fabric as set forth in claim 2, wherein the lower wefts are larger in diameter than the upper wefts.

17. A fabric as set forth in claim 7, wherein the auxiliary wefts being smaller in diameter than the upper wefts.

18. A fabric as set forth in claim 8, wherein the auxiliary wefts being smaller in diameter than the upper wefts.

* * * * *